US008535458B2

(12) United States Patent
Kohsaka et al.

(10) Patent No.: US 8,535,458 B2
(45) Date of Patent: Sep. 17, 2013

(54) HIGH-STRENGTH HOT-ROLLED STEEL SHEET AND METHOD FOR MANUFACTURING THE SAME

(75) Inventors: Noriaki Kohsaka, Tokyo (JP); Kazuhiro Seto, Chiba (JP); Reiko Sugihara, Chiba (JO); Masahide Watabe, Chiba (JP); Yasushi Tanaka, Tokyo (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 13/318,511

(22) PCT Filed: May 11, 2010

(86) PCT No.: PCT/JP2010/058251

§ 371 (c)(1),
(2), (4) Date: Feb. 9, 2012

(87) PCT Pub. No.: WO2010/131761

PCT Pub. Date: Nov. 18, 2010

(65) Prior Publication Data

US 2012/0138197 A1 Jun. 7, 2012

(30) Foreign Application Priority Data

May 12, 2009 (JP) ..... 2009-115072

(51) Int. Cl.
*C22C 38/14* (2006.01)
*C22C 38/04* (2006.01)
*C21D 8/02* (2006.01)

(52) U.S. Cl.
USPC ..... 148/328; 148/320; 148/602; 148/654; 148/661; 148/664

(58) Field of Classification Search
USPC ..... 148/320, 326, 602, 654, 661, 664, 148/328; 420/126
See application file for complete search history.

(56) References Cited

U.S. PATENT DOCUMENTS

2009/0050244 A1* 2/2009 Nakagawa et al. ..... 148/602

FOREIGN PATENT DOCUMENTS

| | | | |
|---|---|---|---|
| EP | 1 028 167 | A2 | 8/2000 |
| EP | 1 338 665 | A1 | 8/2003 |
| EP | 1 559 797 | A1 | 8/2005 |
| EP | 2 014 781 | A1 | 1/2009 |
| EP | 2 050 833 | A1 | 4/2009 |
| JP | 02-008 349 | A | 1/1990 |
| JP | 02-179847 | A | 7/1990 |
| JP | 06-200351 | A | 7/1994 |
| JP | 07-011382 | A | 1/1995 |
| JP | 07-070697 | A | 3/1995 |
| JP | 11-140542 | A | 5/1999 |
| JP | 2001-355040 | | 12/2001 |

(Continued)

*Primary Examiner* — Deborah Yee
(74) *Attorney, Agent, or Firm* — DLA Piper LLP (US)

(57) ABSTRACT

A steel sheet contains, on a mass percent basis, 0.03%-0.12% C, 0.5% or less Si, 0.8%-1.8% Mn, 0.030% or less P, 0.01% or less S, 0.005%-0.1% Al, 0.01% or less N, 0.035%-0.100% Ti, and the balance being Fe and incidental impurities and has microstructures with a fraction of polygonal ferrite of 80% or more, the polygonal ferrite having an average grain size of 5 to 10 μm. The amount of Ti present in a precipitate having a size of less than 20 nm is 70% or more of the value of Ti* calculated using expression (1):

$$Ti^*=[Ti]-48\times[N]/14 \quad (1)$$

where [Ti] and [N] represent a Ti content (percent by mass) and a N content percent by mass), respectively, of the steel sheet.

6 Claims, 3 Drawing Sheets

(56) References Cited

FOREIGN PATENT DOCUMENTS

| | | |
|---|---|---|
| JP | 2002-322541 | 11/2002 |
| JP | 2004-197119 | 7/2004 |
| JP | 2005-314798 | 11/2005 |
| JP | 2007-009322 | 1/2007 |
| JP | 2009-185361 | 8/2009 |
| KR | 100833075 B1 | 5/2008 |

* cited by examiner

HIGH-STRENGTH HOT-ROLLED STEEL SHEET AND METHOD FOR MANUFACTURING THE SAME

RELATED APPLICATIONS

This is a §371 of International Application No. PCT/JP2010/058251, with an international filing date of May 11, 2010 (WO 2010/131761, published Nov. 18, 2010), which is based on Japanese Patent Application No. 2009-115072, filed May 12, 2009, the subject matter of which is incorporated by reference.

TECHNICAL FIELD

This disclosure relates to a high-strength hot-rolled steel sheet having a tensile strength (TS) of 540 MPa or more, only small variations in strength, and excellent uniformity in strength in a coil, the steel sheet being useful for, for example, frame members for heavy vehicles, such as frames for trucks, and relates to a method for manufacturing the high-strength hot-rolled steel sheet.

BACKGROUND

From the viewpoint of global environmental protection, improvement in the fuel economy of automobiles has recently been required to regulate the amount of $CO_2$ emissions, thus requiring weight reductions due to a reduction in the thickness of members used. In addition, it is also required to improve safety by focusing on the crashworthiness of automobile bodies to ensure the safety of passengers at the time of a crash. Thus, both the weight reduction and strengthening of automobile bodies are being actively promoted. To simultaneously achieve the weight reduction and strengthening of automobile bodies, an increase in the strength of a material for members to the extent that stiffness is not impaired and a reduction in weight by reducing the thickness of sheets are said to be effective. Nowadays, high-strength steel sheets are positively used for automotive parts. The use of higher-strength steel sheets results in a more significant weight reduction effect. There is a trend toward the use of steel sheets having a tensile strength (TS) of 540 MPa or more for frame members for heavy vehicles, such as frames for trucks and construction machines.

Many automotive parts made from steel sheets are manufactured by press forming. Regarding the formability of high-strength steel sheets, dimensional accuracy is important in addition to prevention of cracking and wrinkling. In particular, the control of springback is an important problem. Nowadays, new automobiles are developed very efficiently by computer assisted engineering (CAE). So, it is not necessary to make many dies. Furthermore, the input of the characteristics of a steel sheet enables us to predict the amount of springback more accurately. However, in the case of large variations in the amount of springback, prediction accuracy by CAE is disadvantageously reduced. So, in particular, a high-strength steel sheet having only small variations in strength and excellent uniformity in strength is required.

As a method for reducing variations in strength in a coil, Japanese Unexamined Patent Application Publication No. 2004-197119 discloses a method in which a sheet bar composed of precipitation strengthened steel containing Cu, Ni, Cr, Mo, Nb, V, and Ti is subjected to hot finish rolling, air cooling for 1 second or more, and coiling at a temperature ranging from 450° C. to 750° C., so that variations in strength are within ±15 MPa in the longitudinal direction of the resulting coil. Japanese Unexamined Patent Application Publication No. 2002-322541 discloses a high-strength hot-rolled steel sheet with only small variations in strength and excellent uniformity in strength, the steel sheet being produced by the combined addition of Ti and Mo to form very fine precipitates uniformly dispersed therein.

The foregoing related art, however, has problems such as described below. In the method described in Japanese Unexamined Patent Application Publication No. 2004-197119, addition of Nb and Mo causes an increase in cost, which is economically disadvantageous.

In a steel sheet to which Ti, V, and Nb are added to increase the strength, if the temperature of the steel sheet is high after hot finish rolling, coarse precipitates are formed by strain-induced precipitation. So, disadvantageously, the additive elements need to be further added.

Although the steel sheet described in Japanese Unexamined Patent Application Publication No. 2002-322541 is a Ti-containing steel sheet, it is necessary to add Mo, which is expensive, thus causing an increase in cost.

Moreover, in any of the above-described publications, two-dimensional uniformity in strength in the in-plane directions including both of the width direction and the longitudinal direction of the coil is not taken into consideration. Disadvantageously, even if the coiling temperature is uniformly controlled, the variations in the in-plane strength of the coil are inevitably caused by different cooling histories for each position in the coiled coil.

In consideration of the above-described situation, it could be helpful to provide a high-strength hot-rolled steel sheet using an inexpensive, general-purpose Ti-containing steel sheet without using expensive additive elements, e.g., Ni, Nb, or Mo, the steel sheet having a tensile strength (TS) of 540 MPa or more, only small variations in strength, and excellent uniformity in strength in a hot-rolled coil.

SUMMARY

We succeeded in manufacturing a high-strength hot-rolled steel sheet by controlling the chemical composition of the steel sheet, a metal texture, and the precipitation state of Ti that contributes to precipitation strengthening, the steel sheet having only small variations in strength and excellent uniformity in strength.

We thus provide a high-strength hot-rolled steel sheet and a method for manufacturing the high-strength hot-rolled steel sheet, the steel sheet having only small variations in in-plane strength and excellent uniformity in strength.

[1] A high-strength hot-rolled steel sheet includes, on a mass percent basis, 0.03%-0.12% C, 0.5% or less Si, 0.8%-1.8% Mn, 0.030% or less P, 0.01% or less S, 0.005%-0.1% Al, 0.01% or less N, 0.035%-0.100% Ti, the balance being Fe and incidental impurities, and microstructures with a fraction of polygonal ferrite of 80% or more, the polygonal ferrite having an average grain size of 5 to 10 μm, in which the amount of Ti present in a precipitate having a size of less than 20 nm is 70% or more of the value of Ti* calculated using expression (1):

$$Ti^*=[Ti]-48\times[N]/14 \quad (1)$$

where [Ti] and [N] represent a Ti content (percent by mass) and a N content (percent by mass), respectively, of the steel sheet.

[2] A method for manufacturing a high-strength hot-rolled steel sheet includes the steps of heating a steel slab to a temperature of 1200° C. to 1300° C., the steel slab containing, on a mass percent basis, 0.03%-0.12% C, 0.5% or less Si, 0.8%-1.8% Mn, 0.030% or less P, 0.01% or less S, 0.005%-

0.1% Al, 0.01% or less N, 0.035%-0.100% Ti, and the balance being Fe and incidental impurities, subjecting the slab to finish hot rolling at a finishing temperature of 800° C. to 950° C., starting cooling at a cooling rate of 20° C./s or more within 2 seconds after the completion of the finish hot rolling, stopping the cooling at 650° C. to 750° C., subsequently performing natural cooling for 2 seconds to 30 seconds, cooling the steel sheet at a cooling rate of 100° C./s or more, and coiling the steel sheet at 650° C. or lower.

"%" used for components in the steel composition is used to indicate "percent by mass". A high-strength steel sheet is defined as a steel sheet with a tensile strength (hereinafter, also abbreviated as "TS") of 540 MPa or more. The high-strength steel sheet includes a hot-rolled steel sheet and a surface-treated steel sheet produced by subjecting a hot-rolled steel sheet to surface treatment, such as coating treatment.

Our hot-rolled coils have strength variations (ΔTS) of 35 MPa or less.

A high-strength hot-rolled steel sheet having a tensile strength (TS) of 540 MPa or more is provided, the steel sheet having only small variations in in-plane strength. It is possible to reduce variations in strength in a coil of a high-strength hot-rolled steel sheet, thereby achieving the stabilization of the shape fixability of the steel sheet at the time of press forming and the strength and endurance of a part. This leads to improvement in reliability at the time of production and use of automotive parts particularly for heavy vehicles. Furthermore, the above-mentioned effect is provided without adding an expensive raw material, such as Nb, thus leading to cost reduction.

DETAILED DESCRIPTION

Figure 1:
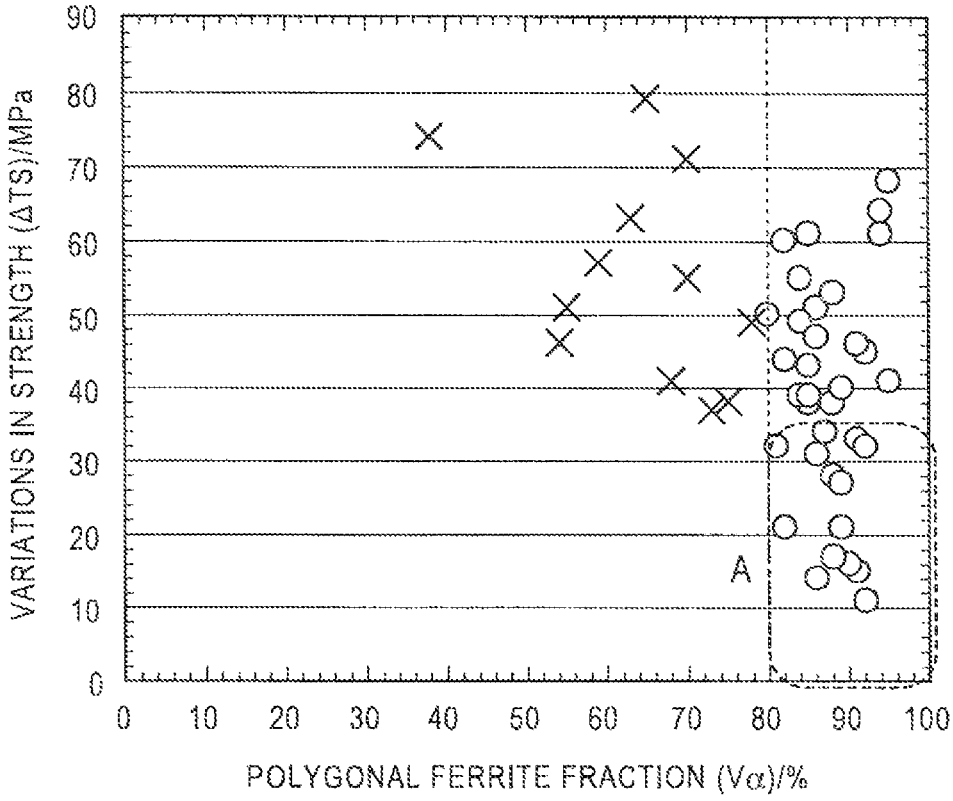
FIG. 1 illustrates the investigation results of the relationship between the polygonal ferrite fraction (%) and variations in strength ΔTS (MPa).

Our steel sheets and methods will be described in detail below.

1) A method for evaluating small variations in strength, i.e., uniformity in strength.

An example of a target steel sheet is a coiled steel sheet having a weight of five tons or more and a width of 500 mm or more. In this case, in an as-hot-rolled state, the innermost turn including the front end in the longitudinal direction, the outermost turn including the rear end in the longitudinal direction, and regions extending from both sides to 10 mm from both sides in the width direction are not evaluated. Variations in the strength (ΔTS) of the steel sheet are evaluated on the basis of tensile-strength distribution obtained from two-dimensional measurement of samples taken from at least 10 divided regions in the longitudinal direction and at least 5 divided regions in the width direction of the steel sheet. Our steel sheets thus have a tensile strength (TS) of 540 MPa or more.

2) The reason for the limitation of the chemical components (composition) of steel will be described below.

C: 0.03% to 0.12%

C is an important element as well as Ti described below. C forms a carbide with Ti and is effective in increasing the strength of a steel sheet by precipitation strengthening. The C content is 0.03% or more from the viewpoint of precipitation strengthening and preferably 1.5 or more times the value of Ti* described below from the viewpoint of the precipitation efficiency of a carbide. A C content exceeding 0.12% is liable to adversely affect toughness and stretch-flangeability. Thus, the upper limit of the C content is set to 0.12% and preferably 0.10% or less.

Si: 0.5% or less

Si is effective in enhancing solid-solution strengthening and improving ductility. To provide the effect, the Si content is effectively 0.01% or more. A Si content exceeding 0.5% is liable to cause the occurrence of a surface defect called red scale during hot rolling, which can reduce the quality of surface appearance and adversely affect fatigue resistance and toughness when a steel sheet is produced. Thus, the Si content is set to 0.5% or less and preferably 0.3% or less.

Mn: 0.8% to 1.8%

Mn is effective in achieving higher strength and has the effect of reducing the transformation point and the ferrite grain size. The Mn content needs to be 0.8% or more. Preferably, the Mn content is set to 1.0% or more. A Mn content exceeding 1.8% causes the formation of a low-temperature transformed phase after hot rolling to reduce the ductility and is liable to make the precipitation of Ti-containing carbide, which is described below, unstable. Thus, the upper limit of the Mn content is set to 1.8%.

P: 0.030% or less

P is an element effective for solid-solution strengthening. P also has the effect of reducing the scale defect due to Si. An excessive P content exceeding 0.030%, however, is liable to cause the segregation of P into grain boundaries and reduce toughness and weldability. Thus, the upper limit of the P content is set to 0.030%.

S: 0.01% or less

S is an impurity and causes hot tearing. Furthermore, S is present in the form of an inclusion in steel, deteriorating the various characteristics of a steel sheet. Thus, the S content needs to be minimized. Specifically, the S content is set to 0.01% or less and preferably 0.005% or less because the S content is allowable to 0.01%.

Al: 0.005% to 0.1%

Al is useful as a deoxidizing element for steel. Al also has the effect of fixing dissolved N present as an impurity, thereby improving resistance to room-temperature aging. To provide the effect, the Al content needs to be 0.005% or more. An Al content exceeding 0.1% leads to an increase in alloy cost and is liable to cause surface defects. Thus, the upper limit of the Al content is set to 0.1%.

N: 0.01% or less

N is an element which degrades the resistance to room-temperature aging and in which the N content is preferably minimized. A higher N content causes a reduction in resistance to room-temperature aging, leading to the precipitation of a coarse Ti-containing nitride that does not significantly contribute to improvement in mechanical properties. To fix dissolved N, large amounts of Al and Ti need to be contained. Thus, the N content is preferably minimized. The upper limit of the N content is set to 0.01%.

Ti: 0.035% to 0.100%

Ti is an important element to strengthen steel by precipitation strengthening. Ti contributes to precipitation strengthening by forming a carbide with C.

To produce a high-strength steel sheet having a tensile strength TS of 540 MPa or more, it is preferred to form fine precipitates each having a size of less than 20 nm. Furthermore, it is important to increase the proportion of the fine precipitates (each having a size of less than 20 nm). The reason for this is presumably that precipitates each having a size of 20 nm or more are less likely to provide the effect of suppressing dislocation migration and fail to sufficiently harden polygonal ferrite, which can reduce the strength. It is thus preferred that the precipitates each have a size of less than 20 nm.

The precipitates containing Ti and C are generically referred to as "Ti-containing carbide". Examples of the Ti-containing carbide include TiC and $Ti_4C_2S_2$. The carbide may further contain N as a component and may be precipitated in combination with, for example, MnS.

In the high-strength steel sheet we found that the Ti-containing carbide is mainly precipitated in polygonal ferrite. The reason for this is presumably that supersaturated C is easily precipitated as carbide in polygonal ferrite because of a low solid-solubility limit of C in polygonal ferrite. The precipitates allow soft polygonal ferrite to harden, thereby achieving a tensile strength (TS) of 540 MPa or more. Ti is readily bonded to dissolved N and thus serves as an element suitable for fixation of dissolved N. The Ti content is set to 0.035% or more also from this standpoint. However, an excessive incorporation of Ti only results in the formation of coarse undissolved TiC or the like, which is a carbide of Ti but does not contribute to strength, and is thus uneconomical, which is not preferred. So, the upper limit of the Ti content is set to 0.100%.

The composition of the balance other than the components described above consists of iron and incidental impurities.

3) The reason for the limitation of the steel microstructure of the steel sheet will be described below.

The steel sheet has microstructures with a fraction of polygonal ferrite of 80% or more, the polygonal ferrite having an average grain size of 5 to 10 μm, in which the amount of Ti present in a precipitate having a size of less than 20 nm is 70% or more of the value of Ti* calculated using expression (1):

$$Ti^*=[Ti]-48\times[N]/14 \quad (1)$$

where [Ti] and [N] represent a Ti content (percent by mass) and a N content (percent by mass), respectively, of the steel sheet.

Based on past experience, the strength of the high-strength hot-rolled steel sheet will be determined by the sum of the base strength of pure iron and four strengthening mechanisms, i.e., solid-solution strengthening, microstructural strengthening due to cementite, grain refinement strengthening due to grain boundaries, and precipitation strengthening due to fine Ti-containing carbide. The base strength is inherent strength of iron. The amount of solid-solution strengthening is almost uniquely determined by a chemical composition. Thus, these two strengthening mechanisms are negligibly involved in the variations in strength in a coil. The strengthening mechanisms that are the most closely related to the variations in strength are microstructural strengthening, grain refinement strengthening, and precipitation strengthening.

The amount of strengthening by microstructural strengthening is determined by the chemical composition and the cooling histories after rolling. The type of steel microstructure is determined by a transformation-temperature range from austenite. If a steel microstructure is determined, the amount of strengthening will be determined.

In grain refinement strengthening, as is known as the Hall-Petch relationship, there is a correlation between a grain-boundary area, i.e., the size of each crystal grain forming a steel microstructure, and the amount of strengthening.

The amount of strengthening by precipitation strengthening is determined by the size and dispersion of precipitates (specifically, precipitate spacing). The dispersion of precipitates can be expressed by the amount and size of the precipitates. Thus, if the size and amount of the precipitates are determined, the amount of strengthening by precipitation strengthening will be determined.

4) Experimental facts will be described below.

Molten steel A having a chemical composition described in Table 1 stated below was made with a converter and formed into slabs by a continuous casting process. These steel slabs were reheated to 1200° C. to 1300° C. and rough-rolled into sheet bars. The sheet bars were finish-rolled at 800° C. to 950° C. Cooling was started at a cooling rate of 25° C./s or more 1.4 to 3.0 seconds after the finish rolling. The cooling was stopped at 600° C. to 780° C. Subsequently, a natural cooling step was performed for 2 to 60 seconds. Cooling was performed again at a cooling rate of 50 to 200° C./s. Coiling was performed at 700° C. or lower to provide the coil of a hot-rolled steel sheet with a thickness of 9 mm. Then 189 tensile test pieces were taken at sampling points of the hot-rolled steel sheet in the same way as in an example described below.

In hot-rolled steel sheets manufactured as described above, the relationship between the polygonal ferrite fraction (%) and variations in strength ΔTS (MPa) was investigated. FIG. 1 illustrates the results. In FIG. 1, the vertical axis indicates the variations in strength ΔTS (MPa). The horizontal axis indicates polygonal ferrite fraction (%). Symbol ○ represents a polygonal ferrite fraction of 80% or more. Symbol x represents a polygonal ferrite fraction of less than 80%.

From FIG. 1, it was found that the variations in strength ΔTS tend to decrease with increasing polygonal ferrite fraction. It was also found that in the case of a polygonal ferrite fraction of 80% or more (symbol ○), some test pieces had a ΔTS of 35 MPa or less (a region surrounded by dotted line A in FIG. 1).

For example, the polygonal ferrite fraction may be determined as follows. A portion of an L section (a section parallel to a rolling direction) of a steel sheet, the portion excluding surface layers each having a thickness equal to 10% of the thickness of the sheet, is etched with 5% Nital. The microstructures of the etched portion are photographed with a scanning electron microscope (SEM) at a magnification of 100×. Smooth ferrite crystal grains in which grain boundaries have a small step height of less than 0.1 μm and in which corrosion marks are not left in the grains are defined as polygonal ferrite. Polygonal ferrite is distinguished from other ferrite phases and different transformed phases, such as pearlite and bainite. These phases are color-coded with image-analysis software. The area ratio of polygonal ferrite is defined as the polygonal ferrite fraction.

A tensile test was performed by a method the same as that in the example described below. The variations in strength (ΔTS) were determined by calculating the standard deviation σ of values of tensile strength TS of the 189 test pieces and then multiplying the resulting standard deviation σ by 4.

Figure 2:
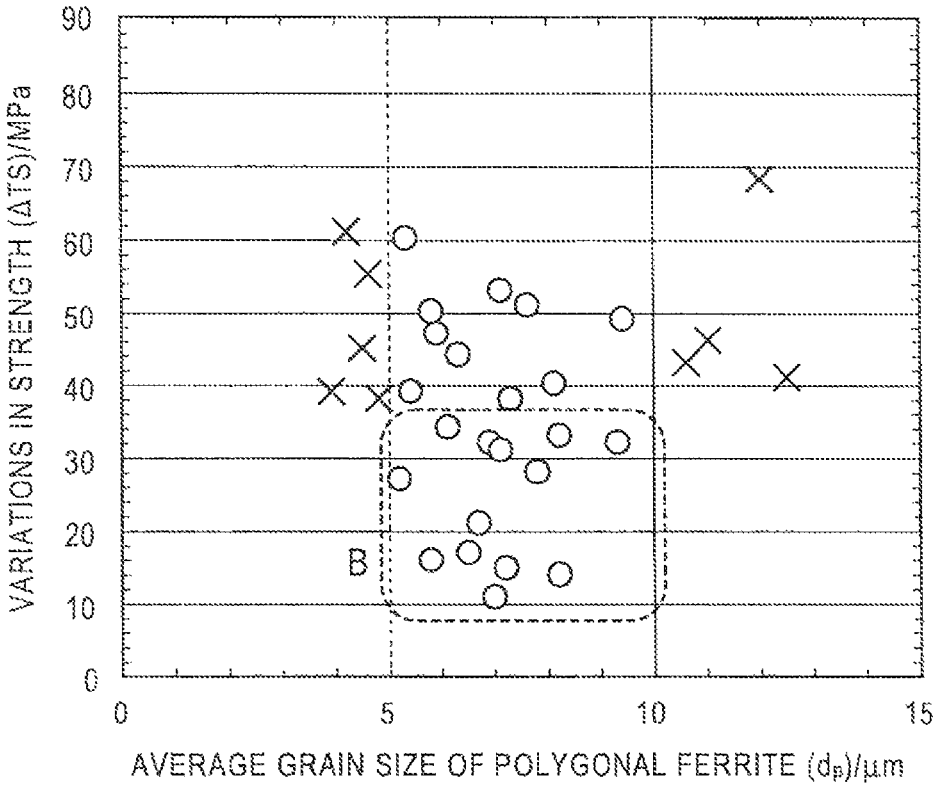
FIG. 2 illustrates the investigation results of the relationship between the grain size (μm) of polygonal ferrite and variations in strength ΔTS (MPa).

On the basis the results described above, steel sheets each having a polygonal ferrite fraction of 80% or more were selected from the hot-rolled steel sheets manufactured as described above. The relationship between the grain size dp (μm) of polygonal ferrite and the variations in strength ΔTS (MPa) was investigated. FIG. 2 illustrates the results. In FIG. 2, the vertical axis indicates the variations in strength ΔTS (MPa). The horizontal axis represents the average grain size dp (μm) of polygonal ferrite. Symbol ○ represents an average grain size of polygonal ferrite of 5 μm to 10 μm. Symbol x represents an average grain size of polygonal ferrite of less than 5 μm or more than 10 μm.

FIG. 2 shows that the variations in strength ΔTS is minimized at an average grain size dp of polygonal ferrite of about 8 μm. It was also found that in the case of an average grain size of polygonal ferrite of 5 μm to 10 μm (symbol ○), some test pieces had a ΔTS of 35 MPa or less (a region surrounded by dotted line B in FIG. 2). However, it is found that in the case of a steel sheet with a thickness of 6 mm or less, the number of grains present in the thickness direction is relatively reduced, so that variations in strength are not overly large enough to cause a problem for a steel material as a whole even at an average grain size of more than 10 μm. Thus, in the case of a thickness of 6 mm or more, the average grain size is set in the range of 5 μm to 10 μm, thereby providing the effect.

The average grain size of polygonal ferrite was determined as follows: The grain size was measured by an intercept method according to JIS G 0551. Three vertical lines and three horizontal lines were drawn on a photograph taken at a magnification of 100×. The average grain size was calculated for each line. The average of the resulting average grain sizes was defined as a final grain size.

Note that the average grain size dp of polygonal ferrite was typified by a value at a middle portion in the longitudinal and transverse directions of the coil.

Figure 3:
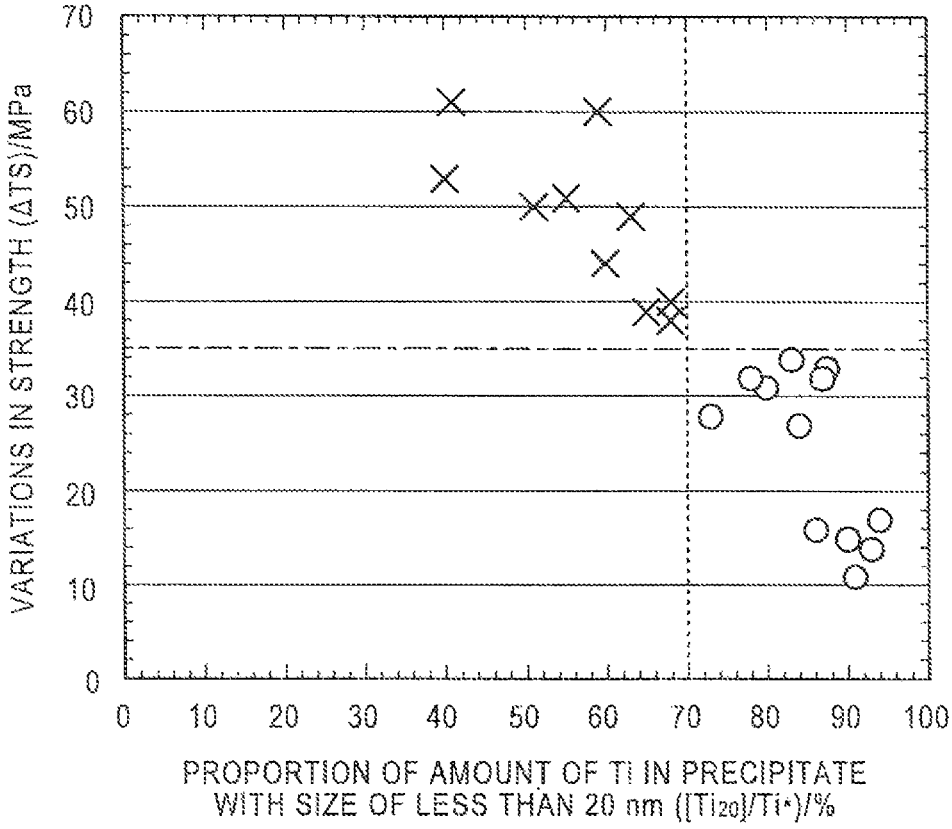
FIG. 3 illustrates the investigation results of the relationship between the proportion (%) of the amount of Ti contained in a precipitate having a size of less than 20 nm with respect to with respect to Ti* and variations in strength ΔTS (MPa).

Steel sheets each having a polygonal ferrite fraction of 80% or more and a grain size of polygonal ferrite of 5 μm to 10 μm were selected from the hot-rolled steel sheets manufactured as described above. The relationship between the variations in strength ΔTS (MPa) and the proportion of the amount of Ti [Ti20] contained in a precipitate with a size of less than 20 nm with respect to Ti*, i.e., [Ti20]/Ti* (%), represented by expression (1) described below was investigated. FIG. 3 illustrates the results.

As described above, the precipitates each having a size of less than 20 nm and contributing to precipitation strengthening contain Ti. Thus, whether Ti is efficiently precipitated as fine precipitates or not can be determined by the grasp of the amount of Ti in the precipitate having a size of less than 20 nm.

In FIG. 3, the vertical axis represents the variations in strength ΔTS (MPa). The horizontal axis represents the proportion of the amount of Ti contained in a precipitate with a size of less than 20 nm with respect to Ti*, i.e., [Ti20]/Ti* (%). Symbol ○ represents the case where the proportion of the amount of Ti contained in a precipitate with a size of less than 20 nm with respect to Ti*, i.e., [Ti20]/Ti* (%), is 70% or more. Symbol x represents the case where the proportion is less than 70%.

FIG. 3 shows that an increase in the proportion of the amount of Ti contained in a precipitate with a size of less than 20 nm, i.e., [Ti20]/Ti*, has the tendency to lead to a reduction in the variations in strength ΔTS. It was also found that in the case where the proportion of the amount of Ti contained in a precipitate with a size of less than 20 nm, i.e., [Ti20]/Ti*, is 70% or more, ΔTS is 35 MPa or less.

Note that the proportion of the amount of Ti contained in a precipitate with a size of less than 20 nm with respect to Ti*, i.e., [Ti20], is typified by a value at a middle portion in the longitudinal and transverse directions of the coil.

From the foregoing results, we discovered that in the case where the steel microstructures have a polygonal ferrite fraction of 80% or more, polygonal ferrite is controlled so as to have an average grain size of 5 μm to 10 μm, and the amount of Ti contained in a precipitate having a size of less than 20 nm is controlled in the range of 70% or more of Ti* represented by expression (1) described below, the variations in strength ΔTS are 35 MPa or less, $$Ti^*=[Ti]-48\times[N]/14 \quad (1)$$

where [Ti] and [N] represent a Ti content (percent by mass) and a N content (percent by mass), respectively, of the steel sheet.

Thus, in the case where the requirements in which a hot-rolled coil has microstructures with a fraction of polygonal ferrite of 80% or more, the polygonal ferrite having an average grain size of 5 to 10 μm, and in which the amount of Ti present in a precipitate having a size of less than 20 nm is 70% or more of the value of Ti* calculated using expression (1) are met at any position of the hot-rolled coil, the variations in the strength of the steel sheet at the positions are small. So, the entire steel sheet has only small variation in strength and excellent uniformity in strength.

5) The amount of Ti contained in a precipitate having a size of less than 20 nm can be measured by a method described below.

After a sample is electrolyzed in an electrolytic solution by a predetermined amount, the test piece is taken out of the electrolytic solution and immersed in a solution having dispersibility. Then precipitates contained in this solution are filtered with a filter having a pore size of 20 nm. Precipitates passing through the filter having a pore size of 20 nm together with the filtrate each have a size of less than 20 nm. After the filtration, the filtrate is appropriately analyzed by inductively-coupled-plasma (ICP) emission spectroscopy, ICP mass spectrometry, atomic absorption spectrometry, or the like to determine the amount of Ti, i.e., [Ti20], in the precipitates each having a size of less than 20 nm with respect to the steel composition.

6) An example of a preferred method for manufacturing a high-strength hot-rolled steel sheet will be described below.

The composition of a steel slab used in the manufacturing method is the same as the composition of the steel sheet described above. Furthermore, the reason for the limitation of the composition is the same as above. The high-strength hot-rolled steel sheet is manufactured through a hot-rolling step of subjecting a raw material to rough hot rolling to form a hot-rolled steel sheet, the raw material being the steel slab having a composition within the range described above.

i) Heating Steel Slab to a Temperature of 1200° C. to 1300° C.

One of the purposes of heating a steel slab before hot rolling is to allow coarse Ti-containing carbide formed before continuous casting to be dissolved in the steel. A heating temperature of less than 1200° C. results in the unstable solid-solution state of the precipitate, thereby causing the uneven amount of fine Ti-containing carbide formed in the subsequent step. So, the lower limit of the heating temperature is set to 1200° C. A heating temperature exceeding 1300° C. results in the adverse effect of increasing the scale loss from surfaces of the slab. Thus, the upper limit is set to 1300° C.

The steel slab heated under the foregoing conditions is then subjected to hot rolling in which rough rolling and finish rolling are performed. The steel slab is formed into a sheet bar by the rough rolling. The conditions of the rough rolling need not be particularly specified. The rough rolling may be performed in the usual manner. It is preferred to use what is called a sheet-bar heater from the viewpoints of reducing the heating temperature of the slab and preventing problems during the hot rolling.

Subsequently, the sheet bar is subjected to finish rolling to form a hot-rolled steel sheet.

ii) Finishing Delivery Temperature (FDT): 800° C. to 950° C.

A finishing temperature of less than 800° C. results in an increase in rolling force to increase the rolling reduction in a austenite non-recrystallization temperature range, thereby leading to the development of an abnormal texture and the formation of coarse precipitates of Ti-containing carbide due to strain-induced precipitation, which is not preferred. A finishing temperature exceeding 950° C. results in an increase in the grain size of polygonal ferrite, thereby reducing formability and scale defects. Preferably, the finishing temperature is set in the range of 840° C. to 920° C.

To reduce the rolling force during the hot rolling, some or all passes of the finish rolling may be replaced with lubrication rolling. The lubrication rolling is effective from the viewpoint of improving uniformity in the shape of a steel sheet and uniformity in strength. The coefficient of friction during the lubrication rolling is preferably in the range of 0.10 to 0.25. Furthermore, a continuous rolling process is preferred in which a preceding sheet bar and a succeeding sheet bar are joined to each other and then the joined sheet bars are continuously finish-rolled. The use of the continuous rolling process is desirable from the viewpoint of achieving the stable operation of the hot rolling.

iii) Cooling (Primary Cooling) at a Cooling Rate of 20° C./s or More within 2 Seconds after Finish Hot Rolling Cooling is started at a cooling rate of 20° C./s or more within 2 seconds after finish hot rolling. When a time exceeding 2 seconds elapses between the start of cooling and the completion of the finish rolling, a strain accumulated during the finish rolling is relieved, thereby leading to an increase in the grain size of polygonal ferrite and the formation of coarse Ti-containing carbide due to strain-induced precipitation. Thus, even if cooling control described below is performed, ferrite is not effectively formed, failing to stably precipitate TiC. Furthermore, the same phenomenon is liable to occur when the cooling rate is less than 20° C./s.

iv) Stop of Cooling in a Temperature Range of 650° C. to 750° C. and Natural Cooling Step for 2 Seconds to 30 Seconds Cooling is stopped at 650° C. to 750° C. Subsequently, natural cooling is performed for 2 seconds to 30 seconds. With respect to a temperature during natural cooling, in order to effectively precipitate Ti-containing carbide, such as TiC, in a short time required for the passage of a steel sheet through a run-out table, it is necessary to hold the steel sheet for a predetermined period of time in a temperature range where ferrite transformation proceeds at a maximum. A natural cooling (holding) temperature of less than 650° C. results in the inhibition of the growth of polygonal ferrite grains, so that the precipitation of Ti-containing carbide is less likely to occur. A natural cooling (holding) temperature exceeding 750° C. leads to the adverse effect of coarsening polygonal ferrite grains and Ti-containing carbide. Accordingly, the natural cooling temperature is set in the range of 650° C. to 750° C.

The minimum natural cooling time is 2 seconds to achieve a polygonal ferrite fraction of 80% or more. A natural cooling time exceeding 30 seconds results in the formation of coarse Ti-containing carbide, thus reducing the strength. Therefore, the natural cooling time is set in the range of 2 seconds to 30 seconds.

v) Cooling (Secondary Cooling) at a Cooling Rate of 100° C./s or More

Cooling is performed again at a cooling rate of 100° C./s or more. To maintain the state of fine Ti-containing carbide stably formed in the foregoing step, a high cooling rate is required. Thus, the lower limit of the cooling rate is set to 100° C./s.

vi) Coiling at 650° C. or Lower

Coiling is performed at 650° C. or lower. A coiling temperature exceeding 650° C. results in an increase in the size of precipitates to cause significant unevenness and thus is not preferred. Lower coiling temperatures do not cause variations in strength. So, the lower limit of the coiling temperature is not specified.

EXAMPLE 1

An example will be described below.

Molten steels having compositions shown in Table 1 were made with a converter and formed into slabs by a continuous casting process. These steel slabs were heated to temperatures shown in Table 2 and rough-rolled into sheet bars. Then the resulting sheet bars were subjected to a hot-rolling step in which finish rolling was performed under conditions shown in Table 2, thereby forming hot-rolled steel sheets.

These hot-rolled steel sheets were subjected to pickling. Regions extending from both sides to 10 mm from both sides in the width direction were removed by trimming. Various properties were evaluated. Steel sheets were taken at positions at which the innermost turn including the front end and the outermost turn including the rear end of the coil in the longitudinal direction were cut. Furthermore, steel sheets were taken at 20 equally divided points of the inner portion in the longitudinal direction. Test pieces for a tensile test and analytical samples of precipitates were taken from both sides of each of the steel sheets in the width direction and 8 equally divided points of each steel sheet in the width direction.

The test pieces for a tensile test were taken in a direction (L direction) parallel to a rolling direction and processed into JIS No. 5 test pieces. The tensile test was performed according to JIS Z 2241 at a crosshead speed of 10 mm/min to determine tensile strength (TS).

With respect to microstructures, a portion of an L section (a section parallel to a rolling direction) of each of the steel sheets, the portion extending from the center in the thickness direction to ±17% of the thickness, was etched with Nital. Sixteen fields of view of the microstructures of the etched portion were observed with a scanning electron microscope (SEM) at a magnification of 400×. The polygonal ferrite fraction was measured by the method described above with image processing software. The grain size of polygonal ferrite was measured by the foregoing method, i.e., the intercept method according to JIS G 0551.

The quantification of Ti in a precipitate having a size of less than 20 nm was performed by a quantitative procedure described below.

The resulting hot-rolled steel sheets described above were cut into test pieces each having an appropriate size. Each of the test pieces was subjected to constant-current electrolysis in a 10% AA-containing electrolytic solution (10 vol % acetylacetone-1 mass % tetramethylammonium chloride-methanol) at a current density of 20 mA/cm$^2$ so as to be reduced in weight by about 0.2 g.

After electrolysis, each of the test pieces having surfaces to which precipitates adhered was taken from the electrolytic solution and immersed in an aqueous solution of sodium hexametaphosphate (500 mg/l) (hereinafter, referred to as an "SHMP aqueous solution"). Ultrasonic vibration was applied thereto to separate the precipitates from the test piece. The separated precipitates were collected in the SHMP aqueous solution. The SHMP aqueous solution containing the precipitates was filtered with a filter having a pore size of 20 nm. After the filtration, the resulting filtrate was analyzed with an ICP emission spectrometer to measure the absolute quantity of Ti in the filtrate. Then the absolute quantity of Ti was divided by an electrolysis weight to obtain the amount of Ti (percent by mass with respect to 100% by mass of all components of the test piece) contained in the precipitates each having a size of less than 20 nm. Note that the electrolysis weight was determined by measuring the weight of the test piece after the separation of the precipitates and subtracting the resulting weight from the weight of the test piece before electrolysis. Next, the resulting amount of Ti (percent by mass) contained in the precipitates each having a size of less than 20 nm was divided by Ti* calculated by substituting the Ti content and the N content shown in Table 1 in formula (1), thereby determining the proportion (%) of the amount of Ti contained in the precipitates each having a size of less than 20 nm.

Table 2 shows the foregoing investigation results of the tensile properties, microstructures, and precipitates of the hot-rolled steel sheets.

TABLE 1

| | Chemical composition (% by mass) | | | | | | | | | |
|---|---|---|---|---|---|---|---|---|---|---|
| Symbol | C | Si | Mn | P | S | Al | N | Ti | Ti* | Remaks |
| A | 0.078 | 0.02 | 1.24 | 0.015 | 0.002 | 0.045 | 0.0025 | 0.060 | 0.051 | Appropriate example |
| B | 0.030 | 0.02 | 1.25 | 0.015 | 0.002 | 0.045 | 0.0025 | 0.062 | 0.053 | Appropriate example |
| C | 0.096 | 0.02 | 1.28 | 0.017 | 0.002 | 0.043 | 0.0046 | 0.076 | 0.060 | Appropriate example |
| D | 0.074 | 0.01 | 1.27 | 0.016 | 0.002 | 0.044 | 0.0041 | 0.087 | 0.073 | Appropriate example |
| E | 0.072 | 0.02 | 1.25 | 0.017 | 0.002 | 0.041 | 0.0011 | 0.036 | 0.032 | Appropriate example |
| F | 0.036 | 0.03 | 1.71 | 0.015 | 0.002 | 0.045 | 0.0015 | 0.039 | 0.034 | Appropriate example |
| G | 0.091 | 0.03 | 0.85 | 0.015 | 0.002 | 0.045 | 0.0075 | 0.085 | 0.059 | Appropriate example |
| H | 0.021 | 0.01 | 1.25 | 0.016 | 0.002 | 0.044 | 0.0041 | 0.074 | 0.060 | Comparative example |
| I | 0.076 | 0.01 | 1.26 | 0.014 | 0.002 | 0.046 | 0.0044 | 0.030 | 0.015 | Comparative example |
| J | 0.086 | 0.02 | 1.25 | 0.015 | 0.002 | 0.045 | 0.0022 | 0.121 | 0.113 | Comparative example |

TABLE 2

| Steel strip No. | Steel No. | Thickness mm | Heating temperature ° C. | Finishing temperature (FDT) ° C. | Cooling start time s | Primary cooling rate ° C./s | Natural cooling temperature ° C. | Natural cooling time s | Secondary cooling rate ° C./s | Coiling temperature after finishing hot rolling (CT) ° C. |
|---|---|---|---|---|---|---|---|---|---|---|
| 1 | A | 6.0 | 1225 | 880 | 1.4 | 25 | 700 | 15 | 110 | 450 |
| 2 | | 14.0 | 1230 | 880 | 1.7 | 40 | 700 | 25 | 200 | 600 |
| 3 | | 9.0 | 1250 | 890 | 1.5 | 35 | 700 | 20 | 110 | 510 |
| 4 | | 9.0 | 1220 | 1000 | 1.5 | 35 | 700 | 20 | 110 | 600 |
| 5 | | 9.0 | 1220 | 890 | 3.0 | 35 | 700 | 20 | 110 | 600 |
| 6 | | 9.0 | 1220 | 880 | 1.5 | 10 | 700 | 20 | 110 | 600 |
| 7 | | 9.0 | 1220 | 880 | 1.5 | 35 | 780 | 20 | 110 | 600 |
| 8 | | 9.0 | 1220 | 880 | 1.5 | 35 | 600 | 20 | 110 | 600 |
| 9 | | 9.0 | 1220 | 880 | 1.5 | 35 | 700 | 60 | 110 | 600 |
| 10 | | 9.0 | 1220 | 880 | 1.5 | 35 | 700 | 20 | 50 | 600 |
| 11 | | 9.0 | 1220 | 890 | 1.5 | 35 | 700 | 20 | 110 | 660 |
| 12 | B | 9.0 | 1220 | 880 | 1.5 | 35 | 700 | 20 | 110 | 600 |
| 13 | C | 9.0 | 1220 | 880 | 1.5 | 35 | 700 | 20 | 110 | 600 |
| 14 | D | 9.0 | 1220 | 880 | 1.5 | 35 | 700 | 20 | 110 | 600 |
| 15 | E | 9.0 | 1230 | 880 | 1.5 | 35 | 700 | 20 | 110 | 600 |
| 16 | F | 9.0 | 1225 | 890 | 1.7 | 35 | 700 | 20 | 110 | 600 |
| 17 | G | 9.0 | 1220 | 880 | 1.5 | 35 | 700 | 20 | 110 | 600 |
| 18 | H | 9.0 | 1220 | 880 | 1.5 | 35 | 700 | 20 | 110 | 600 |
| 19 | I | 9.0 | 1225 | 890 | 1.7 | 35 | 700 | 20 | 110 | 600 |
| 20 | J | 9.0 | 1220 | 880 | 1.5 | 35 | 700 | 20 | 110 | 600 |

| Steel strip No. | Polygonal ferrite traction % | Average grain size of polygonal ferrite μm | Amount of Ti in precipitate with size of less than 20 nm $[Ti_{20}]$ % by mass | Proportion of amount of Ti in precipitate with size of less than 20 nm $[Ti_{20}]/Ti^*$ % | TS MPa | Compliant TS % | ΔTS MPa | Remarks |
|---|---|---|---|---|---|---|---|---|
| 1 | 89 | 6.8 | 0.047 | 91 | 661 | 100 | 21 | Inventive example |
| 2 | 91 | 8.2 | 0.045 | 88 | 613 | 100 | 33 | Inventive example |
| 3 | 85 | 7.5 | 0.044 | 86 | 632 | 100 | 24 | Inventive example |
| 4 | 54 | 19.4 | 0.033 | 64 | 619 | 100 | 46 | Comparative example |
| 5 | 78 | 14.3 | 0.021 | 41 | 578 | 88 | 49 | Comparative example |
| 6 | 95 | 18.5 | 0.015 | 29 | 565 | 52 | 68 | Comparative example |
| 7 | 94 | 16.3 | 0.018 | 35 | 572 | 68 | 61 | Comparative example |
| 8 | 38 | 15.5 | 0.028 | 54 | 668 | 100 | 74 | Comparative example |
| 9 | 95 | 14.6 | 0.040 | 45 | 541 | 69 | 41 | Comparative example |
| 10 | 88 | 7.3 | 0.035 | 68 | 604 | 77 | 38 | Comparative example |
| 11 | 94 | 18.3 | 0.011 | 21 | 583 | 62 | 64 | Comparative example |
| 12 | 92 | 7.4 | 0.043 | 84 | 632 | 100 | 15 | Inventive example |
| 13 | 83 | 6.4 | 0.045 | 75 | 637 | 100 | 26 | Inventive example |
| 14 | 81 | 5.2 | 0.055 | 75 | 640 | 100 | 28 | Inventive example |

TABLE 2-continued

| | | | | | | | | |
|---|---|---|---|---|---|---|---|---|
| 15 | 96 | 9.6 | 0.027 | 84 | 632 | 100 | 24 | Inventive example |
| 16 | 86 | 7.7 | 0.025 | 78 | 598 | 100 | 34 | Inventive example |
| 17 | 86 | 9.9 | 0.023 | 71 | 594 | 100 | 33 | Inventive example |
| 18 | 98 | 14.2 | 0.028 | 47 | 523 | 14 | 56 | Comparative example |
| 19 | 86 | 16.7 | 0.013 | 87 | 493 | 2 | 41 | Comparative example |
| 20 | 91 | 6.5 | 0.055 | 48 | 658 | 100 | 77 | Comparative example |

In the results shown in Table 2, the values of the polygonal ferrite fraction, the grain size, the proportion of the amount of Ti contained in precipitates each having a size of less than 20 nm with respect to Ti* represented by expression (1), and the tensile strength TS are typified by values at a middle portion in the longitudinal and transverse directions of the coils. The proportion of compliant TS is defined as the proportion of points where the tensile strength TS is 540 MPa or more to 189 measurement points. ΔTS is a value obtained by determining the standard deviation σ of TS values at 189 measurement points per sample measured and multiplying the standard deviation σ by 4.

As is clear from the investigation results shown in Table 2, in any of our examples, the steel sheet having satisfactory uniformity in strength is manufactured, in which the steel sheet has a TS of 540 MPa or more, which is high strength, and the variations in strength (ΔTS) in the coil in the in-plane direction are 35 MPa or less, which is small. Furthermore, the compliant TS is mainly closely related to the amount of fine precipitates. A higher proportion of the amount of Ti contained in a precipitate having a size of less than 20 nm results in a higher compliant TS.

As is clear from these results, the variations in strength ΔTS in a hot-rolled coil having a sheet thickness of 6 mm to 14 mm are set to 35 MPa or less. This makes it possible to achieve the stabilization of the shape fixability of the steel sheet for heavy vehicles at the time of press forming and the strength and endurance of a part.

INDUSTRIAL APPLICABILITY

A high-strength hot-rolled steel sheet has a tensile strength (TS) of 540 MPa or more and only small variations in strength. So, for example, the use of a high-strength hot-rolled steel sheet for automotive parts reduces variations in the amount of springback after formation using the high-tensile steel sheet and variations in crashworthiness, thus making it possible to design automobile bodies with higher accuracy and to contribute sufficiently to the collision safety and weight reduction of automobile bodies.

The invention claimed is:

1. A high-strength hot-rolled steel sheet comprising, on a mass percent basis, 0.03%-0.12% C, 0.5% or less Si, 0.8%-1.8% Mn, 0.030% or less P, 0.01% or less S, 0.005%-0.1% Al, 0.01% or less N, 0.035%-0.100% Ti, the balance being Fe and incidental impurities, and microstructures with a fraction of polygonal ferrite of 80% or more, the polygonal ferrite having an average grain size of 5 to 10 μm, wherein an amount of Ti present in a precipitate having a size of less than 20 nm is 70% or more of a value of Ti* calculated using expression (1):

$$Ti^*=[Ti]-48\times[N]/14 \quad (1)$$

where [Ti] and [N] represent Ti content (percent by mass) and N content (percent by mass), respectively, of the steel sheet.

2. A method for manufacturing a high-strength hot-rolled steel sheet, comprising:

heating a steel slab to a temperature of 1200° C. to 1300° C., the steel slab containing, on a mass percent basis, 0.03%-0.12% C, 0.5% or less Si, 0.8%-1.8% Mn, 0.030% or less P, 0.01% or less S, 0.005%-0.1% Al, 0.01% or less N, 0.035%-0.100% Ti, and the balance being Fe and incidental impurities, subjecting the slab to finish hot rolling at a finishing temperature of 800° C. to 950° C., starting cooling at a cooling rate of 20° C./s or more within 2 seconds after the completion of the finish hot rolling, stopping the cooling at 650° C. to 750° C., subsequently performing natural cooling for 2 seconds to 30 seconds, cooling the steel sheet at a cooling rate of 100° C./s or more, and coiling the steel sheet at 650° C. or lower.

3. The high strength hot-rolled steel sheet according to claim 1, having a thickness of ≧6 mm.

4. A method for manufacturing a high-strength hot-rolled steel sheet, comprising:

heating a steel slab to a temperature of 1200° C. to 1300° C., the steel slab containing, on a mass percent basis, 0.03%-0.12% C, 0.5% or less Si, 0.8%-1.8% Mn, 0.030% or less P, 0.01% or less S, 0.005%-0.1% Al, 0.01% or less N, 0.035%-0.100% Ti, and the balance being Fe and incidental impurities, subjecting the slab to finish hot rolling at a finishing temperature of 800° C. to 950° C. to a thickness of ≧6 mm, starting cooling at a cooling rate of 20° C./s or more within 2 seconds after the completion of the finish hot rolling, stopping the cooling at 650° C. to 750° C., subsequently performing natural cooling for 15 seconds to 30 seconds, cooling the steel sheet at a cooling rate of 100° C./s or more, and coiling the steel sheet at 650° C. or lower.

5. The method for manufacturing a high-strength hot-rolled steel sheet according to claim 2, wherein the steel sheet has a tensile strength (TS) of 540-661 MPa.

6. The method of manufacturing a high strength hot-rolled steel sheet according to claim 2, wherein the steel sheet has a ATS of 35 MPa or less.

* * * * *